US011222591B2

(12) United States Patent
Wang et al.

(10) Patent No.: US 11,222,591 B2
(45) Date of Patent: Jan. 11, 2022

(54) OLED DISPLAY PANEL

(71) Applicant: Wuhan China Star Optoelectronics Semiconductor Display Technology Co., LTD., Hubei (CN)

(72) Inventors: Wei Wang, Wuhan (CN); Qing Huang, Wuhan (CN)

(73) Assignee: WUHAN CHINA STAR OPTOELECTRONICS SEMICONDUCTOR DISPLAY TECHNOLOGY CO., LTD., Hubei (CN)

( * ) Notice: Subject to any disclaimer, the term of this patent is extended or adjusted under 35 U.S.C. 154(b) by 183 days.

(21) Appl. No.: 16/621,607

(22) PCT Filed: Sep. 11, 2019

(86) PCT No.: PCT/CN2019/105461
§ 371 (c)(1),
(2) Date: Dec. 11, 2019

(87) PCT Pub. No.: WO2021/035808
PCT Pub. Date: Mar. 4, 2021

(65) Prior Publication Data

US 2021/0327355 A1 Oct. 21, 2021

(30) Foreign Application Priority Data

Aug. 28, 2019 (CN) ..... 201910803933.7

(51) Int. Cl.
*G09G 3/3258* (2016.01)
*G09G 3/3266* (2016.01)
*G09G 3/3291* (2016.01)

(52) U.S. Cl.
CPC ..... *G09G 3/3258* (2013.01); *G09G 3/3266* (2013.01); *G09G 3/3291* (2013.01); *G09G 2300/0426* (2013.01)

(58) Field of Classification Search
CPC .. G09G 3/3258; G09G 3/3266; G09G 3/3291; G09G 3/3233
See application file for complete search history.

(56) References Cited

U.S. PATENT DOCUMENTS 9,886,906 B2 * 2/2018 Tan ..... G09G 3/3233
10,475,386 B2 * 11/2019 Kim ..... G09G 3/3233
(Continued)

*Primary Examiner* — Sardis F Azongha
(74) *Attorney, Agent, or Firm* — Benesch, Friedlander, Coplan & Aronoff LLP

(57) ABSTRACT

An OLED display panel is provided, including: sub-pixels arranged in an array; scanning signal lines, light-emitting signal lines, and first driving voltage lines extending horizontally; and data signal lines, at least one second driving voltage line, and at least one third driving voltage line extending vertically. Each scanning signal line, each light-emitting signal line, and each first driving voltage line are each connected to one row of the sub-pixels. Each data signal line is connected to one column of the sub-pixels. Each first driving voltage line arranged corresponding to each row of the sub-pixels is connected to the second driving voltage line through a first thin film transistor (TFT), and each first driving voltage line arranged corresponding to each row of the sub-pixels is connected to the third driving voltage line through a second TFT. Therefore, brightness deviation or color deviation is avoided when the sub-pixels emit light.

5 Claims, 2 Drawing Sheets

(56) References Cited

U.S. PATENT DOCUMENTS

| | | | | |
|---|---|---|---|---|
| 10,504,424 | B2 * | 12/2019 | Lim | H01L 27/3276 |
| 2016/0358545 | A1 * | 12/2016 | Yin | G09G 3/3258 |

* cited by examiner

OLED DISPLAY PANEL

FIELD OF DISCLOSURE

The present invention relates to a field of display devices and in particular, to an organic light-emitting diode display panel.

DESCRIPTION OF RELATED ART

Organic light-emitting diode (OLED) display panels, also referred to as OLED panel, have advantages such as self-illumination, low driving voltages, high luminous efficiency, short response time, high resolution qualities, great contrast ratios, nearly 180° viewing angle, and operations in a wide temperature range, being flexible, and large-area full-color displays. Therefore, OLED display panels are considered by the industry as the most promising display devices.

OLED is driven by currents. When a current flows through an OLED, the OLED emits light, and brightness of the OLED is determined by the current flowing through the OLED. As shown in FIG. 1, a conventional OLED display panel comprises: a plurality of sub-pixels 10' arranged in an array; a plurality of scanning signal lines 200', a plurality of light-emitting signal lines 30', and a plurality of reset lines 40' extending in a horizontal direction corresponding to each row of the sub-pixels 10'; and a plurality of data signal lines 50' and a plurality of driving voltage lines 60' extending in a vertical direction corresponding to each column of the sub-pixels 10'; a pixel driving circuit in each of the sub-pixels 10' is connected to the corresponding scanning signal line 200', the corresponding light-emitting signal line 30', the corresponding reset line 40', the corresponding data signal line 50', and the corresponding driving voltage line 60'. The scanning signal line 200' is used to provide a scanning signal to the pixel driving circuit, the light-emitting signal line 30' is configured to provide a light-emitting signal to the pixel driving circuit to control an illumination time, and the reset line 40' is configured to provide a reset signal to the pixel driving circuit to erase data signals in the pixel driving circuit after a frame of display image is displayed. The data signal line 50' is used to provide a data signal to the pixel driving circuit, and the driving voltage line 60' is used to apply a driving voltage to the pixel driving circuit to supply a current.

During actual operation of the OLED display panel, a data signal voltage written by the pixel driving circuit in each sub-pixel 10' uses the driving voltage as a reference voltage value. An ideal condition is that the driving voltage is a constant voltage, and the data signal written by the pixel driving circuit is determined only by the data signal voltage written by the data signal line 50'. However, in practice, the driving voltage line 60' has a voltage drop in the vertical direction. That is, each driving voltage line 60' provides a driving voltage for a column of the sub-pixels 10', and a pixel driving current flows through the driving voltage line 60'. The driving voltage line 60' itself has a resistance, so the driving voltage for the column of the sub-pixels 10' will gradually decrease along the vertical direction, thereby causing a certain deviation of the data signal voltage actually written into the pixel driving circuit, thus leading to brightness deviation or color deviation of display images. Further, the driving voltage lines 60' are connected by a driving voltage connecting line 61' extending in the horizontal direction, and as a result, the driving voltage also has a voltage drop in the horizontal direction. The driving voltage connecting line 61' is disposed in a non-display region of the OLED display panel. In order to reduce the voltage drop of the driving voltage connecting line 61' as much as possible in the horizontal direction, it is required to use a driving voltage connecting line 61' with a larger width. Such a configuration is not conducive to the design of narrow-bezel displays.

SUMMARY

The present invention aims to provide an organic light-emitting diode (OLED) display panel, which can prevent brightness deviation or color deviation when sub-pixels emit light, so that the entire display panel has normal brightness and no color shift.

Accordingly, the present invention provides an organic light-emitting diode (OLED) display panel, comprising:

a plurality of sub-pixels arranged in an array;

a plurality of scanning signal lines, a plurality of light-emitting signal lines, and a plurality of first driving voltage lines extending in a horizontal direction; and a plurality of data signal lines, at least one second driving voltage line, and at least one third driving voltage line extending in a vertical direction;

wherein each scanning signal line is connected to one row of the sub-pixels, each of the light-emitting signal lines is connected to one row of the sub-pixels, each of the first driving voltage lines is connected to one row of the sub-pixels, and each of the data signal lines is connected to one column of the sub-pixels;

wherein each of the first driving voltage lines arranged corresponding to each row of the sub-pixels is connected to the second driving voltage line through a first thin film transistor (TFT), a gate electrode of the first TFT is electrically connected to one of the scanning signal lines arranged corresponding to each row of the sub-pixels, a source electrode of the first TFT is electrically connected to the second driving voltage line, and a drain electrode of the first TFT is electrically connected to the first driving voltage lines; and wherein each of the first driving voltage lines arranged corresponding to each row of the sub-pixels is connected to the third driving voltage line through a second TFT, a gate electrode of the second TFT is electrically connected to one of the light-emitting signal lines arranged corresponding to each row of the sub-pixels, a source electrode of the second TFT is electrically connected to the third driving voltage line, and a drain electrode of the second TFT is electrically connected to the first driving voltage lines.

The first TFT and the second TFT are both a P-type TFT.

Each row of the scanning signal lines sequentially provides a low potential scanning signal.

The scanning signal line of an n-th row and the light-emitting signal line of the n-th row arranged corresponding to the n-th row of the sub-pixels are coupled together and successively undergo a data writing phase and a display light-emitting phase, and n is a positive integer;

in the data writing phase, the scanning signal line of the n-th row provides a low potential scanning signal, and the light-emitting signal line of the n-th row provides a high potential light-emitting signal; and in the display light-emitting phase, the scanning signal line of the n-th row provides a high potential scanning signal, and the light-emitting signal line of the n-th row provides a low potential light-emitting signal.

In the data writing phase, the scanning signal line of the n-th row provides a low potential scanning signal to switch on the first TFT, the light-emitting signal line of the n-th row provides the high potential light-emitting signal to switch off the second TFT, the first driving voltage line of the n-th row is electrically connected to the second driving voltage line, the first driving voltage line of the n-th row transmits a standard driving voltage supplied by the second driving voltage line as a driving voltage to the n-th row of the sub-pixels, and a data signal voltage supplied by the data signal line is written to the n-th row of the sub-pixels; and in the display light-emitting phase, the scanning signal line of the n-th row provides the high potential scanning signal to switch off the first TFT, the light-emitting signal line of the n-th row provides the low potential light-emitting signal to switch on the second TFT, the first driving voltage line of the n-th row is electrically connected to the third driving voltage line, the first driving voltage line of the n-th row transmits a driving illumination voltage supplied by the third driving voltage line as a driving voltage to the n-th row of the sub-pixels, and the data signal voltage written to the n-th row of the sub-pixels drives the n-th row of the sub-pixels to emit light.

The OLED display panel further comprises a plurality of reset signal lines extending in the horizontal direction, and each of the reset signal lines is connected to a row of the sub-pixels.

The OLED display panel further comprises a display region and a non-display region surrounding the display region; and wherein the OLED display panel comprises one second driving voltage line and one third driving voltage line, and the second driving voltage line and the third driving voltage line are both disposed at a same side of the non-display region and near the display region.

The OLED display panel further comprises a display region and a non-display region surrounding the display region; and wherein the OLED display panel comprises two second driving voltage lines and the third driving voltage lines, the two second driving voltage lines are disposed at two sides of the non-display region and near the display region, and the two third driving voltage lines are disposed at two sides of the non-display region and near the display region.

The OLED display panel further comprises a display region and a non-display region surrounding the display region; and wherein the OLED display panel comprises at least three second driving voltage lines and at least three third driving voltage lines, the at least three second driving voltage lines are disposed at two sides of non-display region near the display region and in the display region, and the at least three third driving voltage lines are disposed at two sides of the non-display region near the display region and in the display region.

The OLED display panel further comprises a first connection line connected to the at least three second driving voltage lines and a second connection line connected to the at least three third driving voltage lines, wherein the first connection line and the second connection line are both disposed in the non-display region.

Advantages of the present invention: The OLED display panel of the present invention comprises: a plurality of sub-pixels arranged in an array; a plurality of scanning signal lines, a plurality of light-emitting signal lines, and a plurality of first driving voltage lines extending in a horizontal direction; and a plurality of data signal lines, at least one second driving voltage line, and at least one third driving voltage line extending in a vertical direction; each scanning signal line is connected to one row of the sub-pixels, each of the light-emitting signal lines is connected to one row of the sub-pixels, each of the first driving voltage lines is connected to one row of the sub-pixels, and each of the data signal lines is connected to one column of the sub-pixels; wherein each of the first driving voltage lines arranged corresponding to each row of the sub-pixels is connected to the second driving voltage line through a first thin film transistor (TFT), and each of the first driving voltage lines arranged corresponding to each row of the sub-pixels is connected to the third driving voltage line through a second TFT. Therefore, brightness deviation or color deviation is avoided when the sub-pixels emit light, and the entire OLED display panel has normal brightness and no color shift.

BRIEF DESCRIPTION OF DRAWINGS

Please refer to the following detailed description and the accompanying drawings for a better understanding of the features and technical contents of the present invention. The accompanying drawings are provided for illustrative purposes only and are not intended to limit the present invention.

DETAILED DESCRIPTION OF EMBODIMENTS

The following detailed description is provided in conjunction with preferable embodiments and the accompanying drawings to further describe technical solutions and functions of the present invention.

Figure 1:
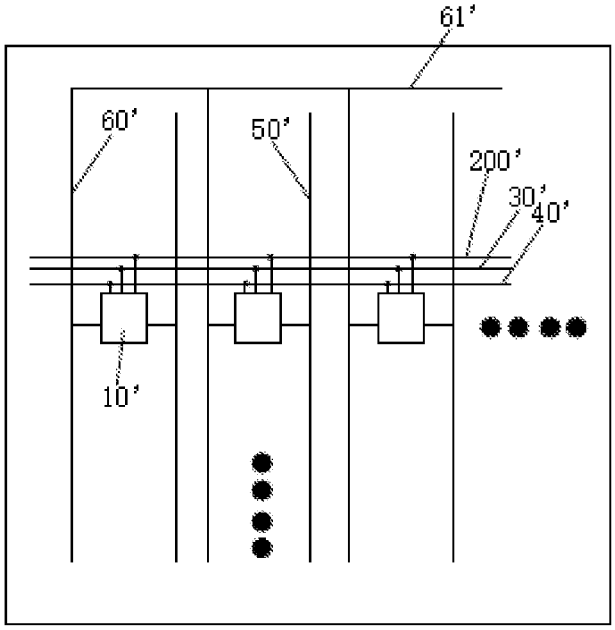
FIG. 1 is a schematic view illustrating an organic light-emitting diode (OLED) display panel of a prior art.
Figure 2:
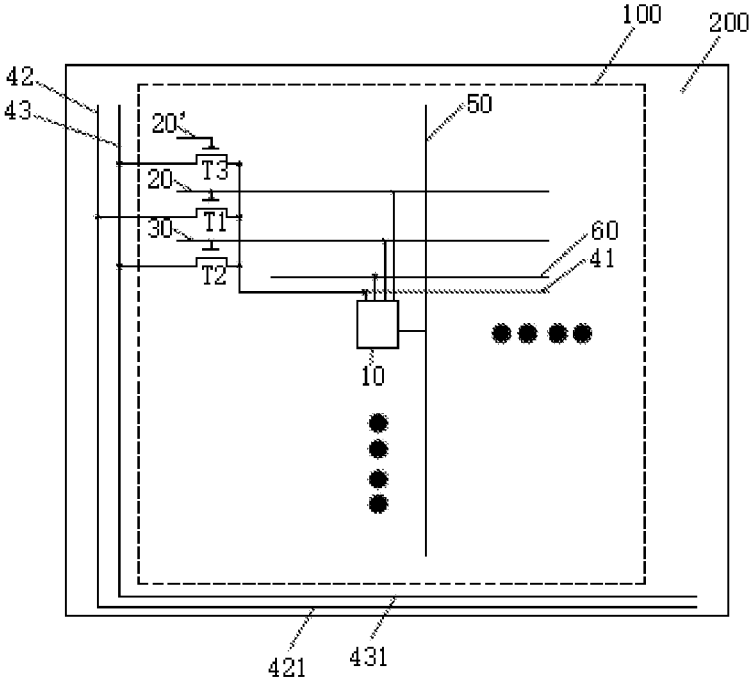
FIG. 2 is a schematic view illustrating an organic light-emitting diode (OLED) display panel of the present invention.
Figure 3:
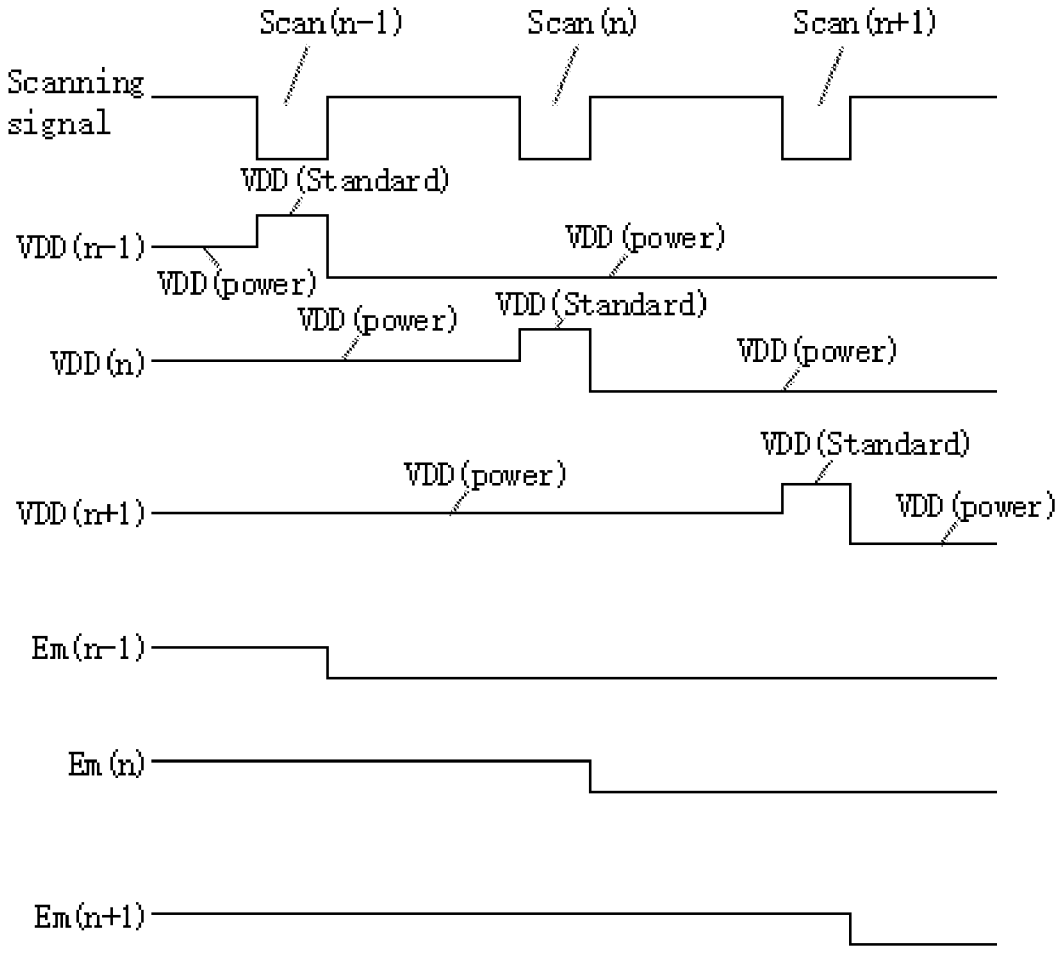
FIG. 3 is a diagram illustrating a driving sequence of the OLED display panel of the present invention.

Please refer to FIGS. 2 and 3, the present invention provides an organic light-emitting diode (OLED) display panel, comprising:

a plurality of sub-pixels 10 arranged in an array;

a plurality of scanning signal lines 20, a plurality of light-emitting signal lines 30, and a plurality of first driving voltage lines 41 extending in a horizontal direction; and a plurality of data signal lines 50, at least one second driving voltage line 42, and at least one third driving voltage line 43 extending in a vertical direction;

wherein each scanning signal line 20 is connected to one row of the sub-pixels 10, each of the light-emitting signal lines 30 is connected to one row of the sub-pixels 10, each of the first driving voltage lines 41 is connected to one row of the sub-pixels 10, and each of the data signal lines 50 is connected to one column of the sub-pixels 10;

wherein each of the first driving voltage lines 41 arranged corresponding to each row of the sub-pixels 10 is connected to the second driving voltage line 42 through a first thin film transistor (TFT) T1, a gate electrode of the first TFT T1 is electrically connected to one of the scanning signal lines 20 arranged corresponding to each row of the sub-pixels 10, a source electrode of the first TFT T1 is electrically connected to the second driving voltage line 42, and a drain electrode of the first TFT T1 is electrically connected to the first driving voltage lines 41; and wherein each of the first driving voltage lines 41 arranged corresponding to each row of the sub-pixels 10 is connected to the third driving voltage line 43 through a second TFT T2, a gate electrode of the second TFT T2 is electrically connected to one of the light-emitting signal lines 30 arranged corresponding to each row of the sub-pixels 10, a source electrode of the second TFT T2 is electrically connected to the third driving voltage line 43, and a drain electrode of the second TFT T2 is electrically connected to the first driving voltage lines 41.

In detail, the first TFT T1 and the second TFT T2 are both a P-type TFT.

Each row of the scanning signal lines 20 sequentially provides a low potential scanning signal.

Referring to FIG. 3, the scanning signal line 20 of an n-th row and the light-emitting signal line 30 of the n-th row arranged corresponding to the n-th row of the sub-pixels 10 are coupled together and successively undergo a data writing phase and a display light-emitting phase, and n is a positive integer;

in the data writing phase, the scanning signal line 20 of the n-th row provides a low potential scanning signal Scan (n), and the light-emitting signal line 30 of the n-th row provides a high potential light-emitting signal Em (n); and in the display light-emitting phase, the scanning signal line 20 of the n-th row provides a high potential scanning signal Scan (n), and the light-emitting signal line 30 of the n-th row provides a low potential light-emitting signal Em (N).

Please refer to FIG. 3 which illustrates the n-th row of the sub-pixels 10 as an example. First, in the data writing phase, the scanning signal line 20 of the n-th row provides a low potential scanning signal Scan (n) to switch on the first TFT T1, the light-emitting signal line of the n-th row provides the high potential light-emitting signal Em (n) to switch off the second TFT T2, the first driving voltage line 41 of the n-th row is electrically connected to the second driving voltage line 42, the first driving voltage line 41 of the n-th row transmits a standard driving voltage VDD (Standard) supplied by the second driving voltage line 42 as a driving voltage VDD (n) to the n-th row of the sub-pixels 10, and a data signal voltage Vdata supplied by the data signal line 50 is written to the n-th row of the sub-pixels 10. Then, in the display light-emitting phase, the scanning signal line 20 of the n-th row provides the high potential scanning signal Scan (n) to switch off the first TFT T1, the light-emitting signal line 30 of the n-th row provides the low potential light-emitting signal Em (n) to switch on the second TFT T2, the first driving voltage line 41 of the n-th row is electrically connected to the third driving voltage line 43, the first driving voltage line 41 of the n-th row transmits a driving illumination voltage VDD (power) supplied by the third driving voltage line 43 as a driving voltage VDD (n) to the n-th row of the sub-pixels 10, and the data signal voltage Vdata written to the n-th row of the sub-pixels 10 drives the n-th row of the sub-pixels 10 to emit light.

Since the first TFT T1 is on an OFF state when the n-th row of the sub-pixels 10 emits light, a pixel driving current for emitting light does not flow through the second driving voltage line 42. Therefore, the second driving voltage line 42 does not have a voltage drop in the vertical direction. The standard driving voltage VDD (Standard) is a constant voltage, and a reference voltage value of the data signal voltage Vdata received by the n-th row of the sub-pixels 10 is a constant standard driving voltage VDD (Standard), so there is substantially no deviation in the data signal voltage Vdata received during the data writing phase. When the n-th row of the sub-pixels 10 is emitting light, the third driving voltage line 43 has a voltage drop in the vertical direction (because the second TFT T2 is turned on in the display light-emitting phase for each row of the sub-pixels), but the driving illumination voltage VDD (power) provided by the third driving voltage line 43 does not affect the data signal voltage Vdata, and therefore the n-th row of the sub-pixels 10 does not have brightness deviation or color deviation when emitting light. Similarly, each row of the sub-pixels 10 does not have brightness deviation or color deviation when emitting light, so that the entire OLED display panel has normal brightness and no color shift.

In detail, the OLED display panel further comprises a plurality of reset signal lines 60 extending in the horizontal direction, and each of the reset signal lines 60 is connected to one row of the sub-pixels 10. The reset signal line 60 is for erasing the data signal voltage Vdata written to the sub-pixels 10 after one frame of display image is displayed.

According to one embodiment of the present invention, the OLED display panel further comprises a display region 100 and a non-display region 200 surrounding the display region 100. The OLED display panel comprises one second driving voltage line 42 and one third driving voltage line 43, and the second driving voltage line 42 and the third driving voltage line 43 are both disposed at a same side of the non-display region 200 and near the display region 100.

According to another embodiment of the present invention, the OLED display panel further comprises a display region 100 and a non-display region 200 surrounding the display region 100. The OLED display panel comprises two second driving voltage lines 42 and the third driving voltage lines 43, the two second driving voltage lines 42 are disposed at two sides of the non-display region 200 and near the display region 100, and the two third driving voltage lines 43 are disposed at two sides of the non-display region 200 and near the display region 100.

According to still another embodiment of the present invention, the OLED display panel further comprises a display region 200 and a non-display region 100 surrounding the display region 100. The OLED display panel comprises at least three second driving voltage lines 42 and at least three third driving voltage lines 43, the at least three second driving voltage lines 42 are disposed at two sides of non-display region 200 near the display region 100 and in the display region 100, and the at least three third driving voltage lines 43 are disposed at two sides of the non-display region 200 near the display region 100 and in the display region 100.

The OLED display panel further comprises a first connection line 421 connected to the at least three second driving voltage lines 42 and a second connection line 431 connected to the at least three third driving voltage lines 43, wherein the first connection line 421 and the second connection line 431 are both disposed in the non-display region 200. The second driving voltage line 42 does not have a voltage drop in the vertical direction, and the third driving voltage line 43 has a voltage drop in the vertical direction but does not affect the data signal voltage Vdata, so widths of the first connection line 421 and the second connection line 431 can be reduced as much as possible to facilitate a narrow bezel design of the OLED display panel.

Specifically, each of the first driving voltage lines 41 disposed corresponding to each row of the sub-pixels 10 is connected to the third driving voltage line 43 through a third TFT T3, wherein a gate electrode of the third TFT T3 is electrically connected to a scanning signal line 20' arranged corresponding to a preceding row of the sub-pixels 10. A source electrode of the third TFT T3 is electrically connected to the third driving voltage line 43. A drain electrode of the third TFT T3 is electrically connected to the first driving voltage line 41. That is, the first driving voltage line 41 arranged corresponding to the n-th row of the sub-pixels 10 is connected to the third driving voltage line 43 and the scanning signal line 20' disposed corresponding to the (n−1)-th row of the sub-pixels 10 through the third TFT T3.

In summary, the OLED display panel of the present invention comprises: a plurality of sub-pixels arranged in an array; a plurality of scanning signal lines, a plurality of light-emitting signal lines, and a plurality of first driving voltage lines extending in a horizontal direction; and a plurality of data signal lines, at least one second driving voltage line, and at least one third driving voltage line extending in a vertical direction; each scanning signal line is connected to one row of the sub-pixels, each of the light-emitting signal lines is connected to one row of the sub-pixels, each of the first driving voltage lines is connected to one row of the sub-pixels, and each of the data signal lines is connected to one column of the sub-pixels; wherein each of the first driving voltage lines arranged corresponding to each row of the sub-pixels is connected to the second driving voltage line through a first thin film transistor (TFT), and each of the first driving voltage lines arranged corresponding to each row of the sub-pixels is connected to the third driving voltage line through a second TFT. Therefore, brightness deviation or color deviation is avoided when the sub-pixels emit light, and the entire OLED display panel has normal brightness and no color shift.

It should be noted that, various changes and modifications can be made by persons of ordinary skills in the art in accordance with the technical solutions and technical concept of the present invention, and all such changes and modifications are deemed to be within the protection scope of the present invention.

What is claimed is:

1. An organic light-emitting diode (OLED) display panel, comprising:

a plurality of sub-pixels arranged in an array;

a plurality of scanning signal lines arranged in a plurality of rows respectively, a plurality of light-emitting signal lines arranged in a plurality of rows respectively, and a plurality of first driving voltage lines arranged in a plurality of rows respectively, wherein the scanning signal lines, the light-emitting signal lines, and the first driving voltage lines extend in a horizontal direction; and a plurality of data signal lines, at least one second driving voltage line, and at least one third driving voltage line extending in a vertical direction;

wherein each scanning signal line is connected to one row of the sub-pixels, each of the light-emitting signal lines is connected to one row of the sub-pixels, each of the first driving voltage lines is connected to one row of the sub-pixels, and each of the data signal lines is connected to one column of the sub-pixels;

wherein each of the first driving voltage lines arranged corresponding to each row of the sub-pixels is connected to the second driving voltage line through a first thin film transistor (TFT), a gate electrode of the first TFT is electrically connected to one of the scanning signal lines arranged corresponding to each row of the sub-pixels, a source electrode of the first TFT is electrically connected to the second driving voltage line, and a drain electrode of the first TFT is electrically connected to the first driving voltage lines; and wherein each of the first driving voltage lines arranged corresponding to each row of the sub-pixels is connected to the third driving voltage line through a second TFT, a gate electrode of the second TFT is electrically connected to one of the light-emitting signal lines arranged corresponding to each row of the sub-pixels, a source electrode of the second TFT is electrically connected to the third driving voltage line, and a drain electrode of the second TFT is electrically connected to the first driving voltage lines;

wherein the scanning signal line in the n-th row and the light-emitting signal line in the n-th row arranged corresponding to the n-th row of the sub-pixels are coupled together and successively undergo a data writing phase and a display light-emitting phase, and n is a positive integer;

in the data writing phase, the scanning signal line in the n-th row provides a low potential scanning signal, and the light-emitting signal line in the n-th row provides a high potential light-emitting signal;

in the display light-emitting phase, the scanning signal line in the n-th row provides a high potential scanning signal, and the light-emitting signal line in the n-th row provides a low potential light-emitting signal;

in the data writing phase, the scanning signal line in the n-th row provides a low potential scanning signal to switch on the first TFT, the light-emitting signal line in the n-th row provides the high potential light-emitting signal to switch off the second TFT, the first driving voltage line in the n-th row is electrically connected to the second driving voltage line, the first driving voltage line in the n-th row transmits a standard driving voltage supplied by the second driving voltage line as a driving voltage to the n-th row of the sub-pixels, and a data signal voltage supplied by the data signal line is written to the n-th row of the sub-pixels; and in the display light-emitting phase, the scanning signal line in the n-th row provides a high potential scanning signal, and the light-emitting signal line in the n-th row provides a low potential light-emitting signal, wherein in the display light-emitting phase, the scanning signal line in the n-th row provides the high potential scanning signal to switch off the first TFT, the light-emitting signal line in the n-th row provides the low potential light-emitting signal to switch on the second TFT, the first driving voltage line in the n-th row is electrically connected to the third driving voltage line, the first driving voltage line in the n-th row transmits a driving illumination voltage supplied by the third driving voltage line as a driving voltage to the n-th row of the sub-pixels, and the data signal voltage written to the n-th row of the sub-pixels drives the n-th row of the sub-pixels to emit light.

2. The OLED display panel according to claim 1, wherein the first TFT and the second TFT are both a P-type TFT.

3. The OLED display panel according to claim 2, wherein each row of the scanning signal lines sequentially provides a low potential scanning signal.

4. The OLED display panel according to claim 1, further comprising a plurality of reset signal lines extending in the horizontal direction, and each of the reset signal lines is connected to a row of the sub-pixels.

5. The OLED display panel according to claim 1, further comprising a display region and a non-display region surrounding the display region; and wherein the OLED display panel comprises one second driving voltage line and one third driving voltage line, and the second driving voltage line and the third driving voltage line are both disposed at a same side of the non-display region and near the display region.

* * * * *